US008262870B2

(12) United States Patent
Fairbourn et al.

(10) Patent No.: US 8,262,870 B2
(45) Date of Patent: Sep. 11, 2012

(54) APPARATUS, METHODS, AND COMPOSITIONS FOR REMOVING COATINGS FROM A METAL COMPONENT

(75) Inventors: David C. Fairbourn, Sandy, UT (US); Max Sorenson, Salt Lake City, UT (US)

(73) Assignee: Aeromet Technologies, Inc., Sandy, UT (US)

( * ) Notice: Subject to any disclaimer, the term of this patent is extended or adjusted under 35 U.S.C. 154(b) by 1128 days.

(21) Appl. No.: 12/046,708

(22) Filed: Mar. 12, 2008

(65) Prior Publication Data

US 2009/0120804 A1 May 14, 2009

Related U.S. Application Data

(63) Continuation-in-part of application No. 11/423,363, filed on Jun. 9, 2006, now abandoned.

(60) Provisional application No. 60/689,482, filed on Jun. 10, 2005, provisional application No. 60/690,262, filed on Jun. 14, 2005.

(51) Int. Cl.
*C25F 5/00* (2006.01)

(52) U.S. Cl. ..... 204/228.6; 205/641; 205/717

(58) Field of Classification Search ..... 204/228.6; 205/641, 717
See application file for complete search history.

(56) References Cited

U.S. PATENT DOCUMENTS 3,669,858 A * 6/1972 La Boda ..... 205/221
4,268,397 A 5/1981 Horie et al.
4,608,091 A 8/1986 Sullivan et al.
4,746,369 A 5/1988 Sullivan et al.
5,062,941 A 11/1991 Sue
5,232,619 A 8/1993 Sue
5,290,362 A 3/1994 Sue
5,770,039 A * 6/1998 Rigney et al. ..... 205/789
6,294,072 B1 9/2001 Fairbourn
6,332,970 B1 * 12/2001 Coffey ..... 205/720
6,428,683 B1 8/2002 Jaworowski et al.
6,579,439 B1 * 6/2003 Chandler ..... 205/671
6,623,564 B2 9/2003 Yamaguchi et al.
6,645,365 B2 11/2003 Fairbourn et al.
6,837,985 B2 1/2005 Fairbourn et al.
7,332,024 B2 2/2008 Kool
7,896,726 B1 3/2011 Miller et al.
(Continued)

OTHER PUBLICATIONS

USPTO, final Office Action issued in related U.S. Appl. No. 11/423,363 dated Jun. 18, 2010.

(Continued)

*Primary Examiner* — Nicholas A. Smith
(74) *Attorney, Agent, or Firm* — Wood, Herron & Evans, LLP

(57) ABSTRACT

Apparatus and methods for removing coatings from metal components, such as metal components used in aircraft and other aerospace vehicles and the oil industry, as well as aqueous bath compositions. The metal component may be DC coupled with a counter electrode and immersed in an aqueous bath that includes an active oxygen source and a ligand in a composition effective to remove the coating. The aqueous bath may include hydrogen peroxide as the active oxygen source and may be maintained in a specific pH range if the temperature of the aqueous bath is controlled. In an alternative embodiment, the composition of the aqueous bath may include a non-peroxide active oxygen source, such as sodium perborate, and be maintained in a different specific pH range. An oxygen sensor may be provided to periodically monitor the concentration of active oxygen in the aqueous bath.

14 Claims, 2 Drawing Sheets

U.S. PATENT DOCUMENTS

| | | | | |
|---|---|---|---|---|
| 2002/0108861 | A1 | 8/2002 | Emesh et al. | |
| 2003/0062271 | A1 | 4/2003 | Kool et al. | |
| 2004/0195110 | A1 * | 10/2004 | Emesh et al. | 205/652 |
| 2005/0164498 | A1 * | 7/2005 | Ide et al. | 438/678 |
| 2005/0199510 | A1 * | 9/2005 | Kochergin et al. | 205/640 |
| 2005/0218010 | A1 * | 10/2005 | Wang et al. | 205/677 |
| 2006/0027463 | A1 | 2/2006 | Lavelle et al. | |
| 2007/0051619 | A1 * | 3/2007 | Mazur et al. | 204/250 |

OTHER PUBLICATIONS

USPTO, Office Action issued in related U.S. Appl. No. 11/423,363 dated Dec. 23, 2009.

U.S. Patent and Trademark Office, Office Action in U.S. Appl. No. 12/415,492, dated Jan. 18, 2012.

* cited by examiner

APPARATUS, METHODS, AND COMPOSITIONS FOR REMOVING COATINGS FROM A METAL COMPONENT

CROSS-REFERENCE TO RELATED APPLICATIONS

This application is a continuation-in-part of application Ser. No. 11/423,363, filed on Jun. 9, 2006, which claims the benefit of U.S. Provisional Application No. 60/689,482, filed Jun. 10, 2005, and claims the benefit of U.S. Provisional Application No. 60/690,262, filed Jun. 14, 2005, the disclosure of each of which is hereby incorporated by reference herein in its entirety.

FIELD OF THE INVENTION

The invention relates to stripping coatings from metal components and, more particularly, to apparatus, methods, and compositions for removing coatings from metal components used in aircraft and other aerospace vehicles.

BACKGROUND OF THE INVENTION

Aircraft landing gears include metal components, such as inner and outer cylinders, axles, pins, and actuators, formed from high strength structural materials like steel alloys. The metal components of aircraft landing gears, as well as the metal segments or components of exhaust augmentor flaps or turkey feathers and compressor blades found in aircraft engines, are often encapsulated or at least partially covered by a coating to provide a beneficial effect, such as corrosion resistance. For example, a coating, such as WCCo CrC/NiCr, or (WC/CoCr), may be applied to these metal components by, for example, a plasma spraying technique or by a high velocity oxygen fuel (HVOF) thermal spray process. The coatings are also used to coat shafts, gear boxes, and other wear parts in other industries, such as the oil industry.

Landing gears and exhaust augmentor flaps, as well as compressor blades and other rotating engine parts, are periodically removed from aircraft to inspect the material forming the metal components for stress corrosion, cracking, or other evidence of a condition that could lead to a field failure while in service. The inspection requires that the coating be stripped so that the coating does not interfere with the inspection process. For example, a porous coating may restrict the ability of a penetrant to reach the underlying structural material. If the component passes inspection, a new coating is applied to the metal component before the landing gear or exhaust augmentor flap is returned to service.

Conventional processes for stripping coatings suffer from various deficiencies. For example, a reverse plating process using an aqueous bath containing tartaric acid may be used to remove tungsten-containing coatings. However, this particular reverse plating process is expensive and slow. Aqueous baths containing acids may cause metal components formed from high strength steel alloys to be susceptible to hydrogen ion embrittlement. Embrittled metal components may become susceptible to damage from shock. Although residual trapped hydrogen in the stripped metal components may be removed by a low temperature bake, the required length of the bake slows process throughput.

Stripping solutions are known for removing compounds of titanium from base metals. Generally, these stripping methods immerse the component in a solution including a source of active oxygen and a suitable acid. Under certain conditions, stripping solutions in which hydrogen peroxide acts as the active oxygen source in the composition may spontaneously lose the active oxygen at a dramatic rate. To alleviate this problem, hydrogen peroxide may be replaced with a different type of active oxygen source, such as a chemical substance like sodium perborate tetrahydrate that dissociates in water to form active oxygen. The solution must also include an alkaline source of hydroxyl ions, such as ammonium hydroxide, sodium hydroxide, or potassium hydroxide, which maintains the solution pH at a pH value exceeding 8.0.

Nevertheless, there is a need for improved apparatus, methods, and compositions to efficiently remove coatings from metal components used in aircraft and other aerospace vehicles.

SUMMARY OF INVENTION

The invention provides, in one aspect, an improved method for efficiently removing a coating from a metal component used in aircraft and other aerospace vehicles that measures an oxygen concentration of an aqueous bath, which contacts at least a portion of the metal component, and adds an amount of the active oxygen source to the aqueous bath if the measured oxygen concentration differs from a reference oxygen concentration. By virtue of the foregoing, there is provided a method for removing coatings in which the active oxygen content of the aqueous bath is tracked and adjusted to optimize removal as the composition or chemistry of the aqueous bath is altered by the coating-removal process.

The invention provides, in another aspect, an improved apparatus that includes a first sensor in fluid communication with an aqueous bath, which contacts at least a portion of the metal component, and adapted to measure an oxygen concentration of the aqueous bath. The apparatus further includes a control system responsive to output signals indicative of the oxygen concentration supplied from the first sensor to cause an additional amount of a first aqueous bath component to be added to the aqueous bath. Advantageously, the sensor and control system cooperate to adjust the composition or chemistry of the aqueous bath if the measured value of the oxidation reduction potential deviates from a reference value, which maintains the efficiency of the stripping process as the coating-removal process modifies the composition or chemistry of the aqueous bath. The use of the oxygen sensor may improve the ability of the control system to respond to measured variations in the active oxygen content with relatively high concentrations of a ligand, such as citric acid, in the aqueous bath and, in particular, with a concentration of the ligand to endow the bath with a relatively low pH value, such as pH values of about 1.75 to about 2.75.

The invention provides, in another aspect, an improved method for efficiently removing a coating from a metal component used in aircraft and other aerospace vehicles that measures an oxidation reduction potential of an aqueous bath, which contacts at least a portion of the metal component, and adds an amount of the active oxygen source to the aqueous bath to increase the oxidation reduction potential if the measured oxidation reduction potential differs from a reference oxidation reduction potential. By virtue of the foregoing, there is provided a method for removing coatings in which the active oxygen content of the aqueous bath is tracked and adjusted to optimize removal as the composition or chemistry of the aqueous bath is altered by the coating-removal process.

The invention provides, in another aspect, an improved method for efficiently removing a coating from a metal component used in aircraft and other aerospace vehicles by adjusting the composition of an aqueous bath, which contacts at least a portion of the metal component, to maintain the pH value between about 7.0 and about 9.0. By virtue of the foregoing, there is provided a method for removing coatings in which the pH value of the aqueous bath is adjusted so that the substrate of the metal component is not damaged by chemical attack by the aqueous bath. The adjustments may be made in response to changes in the composition or chemistry of the aqueous bath resulting from the coating-removal process.

The invention provides, in another aspect, an improved apparatus that includes a first sensor in fluid communication with an aqueous bath, which contacts at least a portion of the metal component, and adapted to measure an oxidation reduction potential of the aqueous bath. The apparatus further includes a control system responsive to output signals indicative of the oxidation reduction potential supplied from the first sensor to cause an additional amount of a first aqueous bath component to be added to the aqueous bath. Advantageously, the sensor and control system cooperate to adjust the composition or chemistry of the aqueous bath if the measured value of the oxidation reduction potential deviates from a reference value, which maintains the efficiency of the stripping process as the composition or chemistry of the aqueous bath is modified by the coating-removal process.

In another aspect, the invention provides compositions for an aqueous bath used to remove at least a portion of a coating from a metal component.

In one embodiment, the composition comprises water, hydrogen peroxide ($H_2O_2$), and a ligand selected from the group consisting of citric acid ($C_6H_8O_7$), oxalic acid ($C_2H_2O_4$), tartaric acid ($C_4H_6O_6$), formic acid ($CH_2O_2$), or glucose (6-(hydroxymethyl) oxane-2,3,4,5-tetrol). The ligand is present with a concentration sufficient to provide a pH value of about 1.75 to about 2.75. These pH values of the composition may be beneficial if the coating to be stripped using the composition contains nickel or chromium.

As understood by a person having ordinary skill in chemistry, a ligand is an atom, ion, molecule, or a functional group that generally donates one or more of its electrons through a coordinate covalent bond to, or shares its electrons through a covalent bond, or through a pi-bond, with one or more central atoms or ions. These latter ligands act as a Lewis base.

In another embodiment, the composition comprises water, an active oxygen source selected from the group consisting of sodium perborate tetrahydrate ($NaBO_3.4H_2O$), sodium perborate monohydrate ($NaBO_3.H_2O$) prepared by dehydrating sodium perborate tetrahydrate, sodium percarbonate ($Na_2CO_3 1\frac{1}{2}H_2O_2$), boric acid ($H_3BO_3$), and combinations thereof, and a ligand selected from the group consisting of citric acid ($C_6H_8O_7$), oxalic acid ($C_2H_2O_4$), tartaric acid ($C_4H_6O_6$), formic acid ($CH_2O_2$), glucose (6-(hydroxymethyl)oxane-2,3,4,5-tetrol), and combinations thereof. A pH value of the composition is within a range of about 7.0 to about 9.0. If coating to be stripped using the composition fails to contain nickel or chromium to impart corrosion resistance in acidic stripping solutions, then this composition may be particularly beneficial for stripping such coatings.

These and other objects and advantages of the invention shall be made apparent from the accompanying drawings and description thereof.

BRIEF DESCRIPTION OF THE DRAWINGS

The accompanying drawings, which are incorporated in and constitute a part of this specification, illustrate an embodiment of the invention and, together with a general description of the invention given above, and the detailed description of the embodiment given below, serve to explain the principles of the invention.

DETAILED DESCRIPTION

Figure 1:
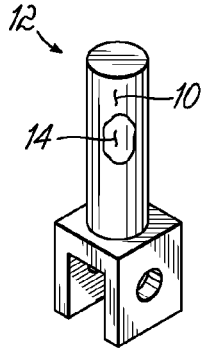
FIG. 1 is a highly schematic, not to scale view of a metal component bearing a coating to be stripped in accordance with the invention.
Figure 2:
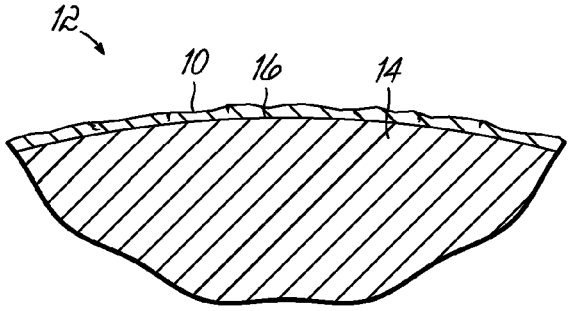
FIG. 2 is a cross-sectional view of an edge portion of the metal component and coating of FIG. 1.

With reference to FIGS. 1-4, the invention provides for the removal or stripping of a coating 10 from a metal component 12 representative of a metal component of an aircraft landing gear. The coating 10 may be composed of tungsten carbide cobalt (WCCo), CrC/NiCr, tungsten carbide cobalt-chromium (WC/CoCr), or another material, such as a material characteristic of plasma-sprayed coatings applied by high-velocity oxy-fuel (HVOF) techniques, air plasma spray techniques, cold spray techniques, combustion wire techniques, cold spray techniques, combustion wire techniques, arc spray techniques, arc wire spray techniques, or combustion powder techniques. A substrate 14 of the metal component 12 is formed from a structural material, such as a high strength structural steel alloy, that differs in composition from the material forming the coating 10. The coating 10 is applied to an original surface 16 of substrate 14. If the coating 10 is completely or almost completely removed, all or a portion the original surface 16 is revealed.

The landing gear is understood to include additional metal components, in addition to the illustrated metal component 12, that would benefit from coating stripping as described herein. The invention also contemplates that the metal component 12 may consist of an assembly of several individual components that are simultaneously removed by a single stripping operation. Exemplary metal components 12 of a landing gear include, but are not limited to, the inner and outer cylinders, axles, pins, actuators such as hydraulic actuators, and assemblies of these and other individual components. The assemblies may include additional components (not shown) that are uncoated by the coating 10.

Metal component 12 may also comprise an exhaust augmentor flap segment or component normally used in service near the exhaust outlet of a jet engine. The substrate 14 of this type of metal component 12 may be formed from a material, such as titanium, Inconel 718 (a nickel based superalloy), or another suitable material as understood by a person having ordinary skill in the art.

Figure 3:
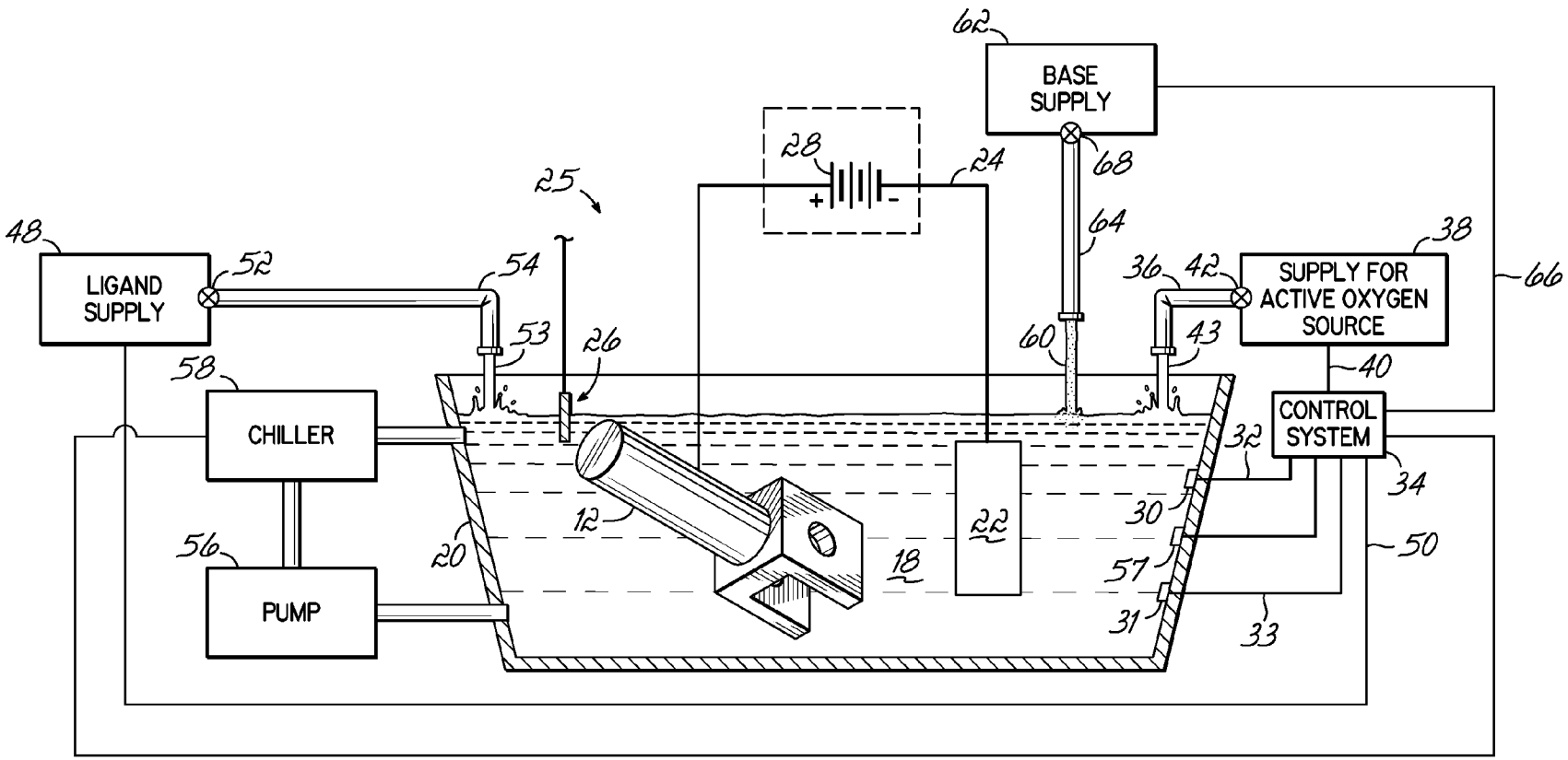
FIG. 3 is a diagrammatic view of an apparatus for stripping the coating from the metal component of FIG. 1 in accordance with an embodiment of the invention.

In accordance with the principles of the various embodiments of the invention, the coating 10 is stripped from at least a portion of the metal component 12 to reveal the original surface 16 of the substrate 14. Metal component 12 is associated with an aqueous bath 18, such as by being fully or at least partially immersed in a solution-filled tank or container 20 of a stripping apparatus 25 as shown in FIG. 3. Only a portion of the metal component 12 may be contacted or wetted by the aqueous bath 18 so that the coating 10 is only removed from the wetted portion and remains substantially intact on the unwetted regions after the stripping process. It is contemplated that residual coating 10 may remain on a portion of the metal component 12. The invention contemplates that the stripping process removing the coating 10 may also remove or mill away a minor thickness of the substrate 14 of the metal component 12 after the coating 10 is at least partially removed. Preferably, the substrate 14 is undamaged by the stripping operation or any damage suffered is negligible.

Container 20 may be made of any material appropriate for the particular application, such selection being within the ordinary skill of one in the art, and for example, may comprise plastic or metal, such as stainless steel. The container 20 is dimensioned and the volume of solution constituting aqueous bath 18 is sufficient to receive and fully immerse the metal component 12. The metal component 12, which is part of an assembly designed to support the massive weight of an aircraft under the violent impact and shock of landing, is understood by persons of ordinary skill in the art to be dimensionally large and bulky. Consequently, removing coating 10 from component 12 requires a relatively large container 20 and a relatively large volume of solution in aqueous bath 18. Consequently, container 20 is of a type that would not be used in small-scale laboratory experiments.

For example, container 20 may be sized to hold a bath 18 of up to 9000 gallons (34,000 liters) of solution for stripping metal components 12 that may approach about 15 feet (about 4.572 meters) in length and about 1 foot (about 0.3048 meter) in diameter. Alternatively, if the metal component 12 originates from an exhaust augmentor flap, container 20 may be sized to hold a bath 18 of up to 40 liters (1.413 cubic feet) of solution for stripping metal components 12 of an exhaust augmentor flap that may approach about 19 inches (about 48.26 centimeters) in length and about 8 inches (about 20.32 centimeters) or so in width.

The aqueous bath 18 may be at room temperature, which varies according to the environment, but it is typically between about 55° F. and about 105° F. (about 13° C. to about 41° C.). In one embodiment, the aqueous bath 18 may be maintained at about 95° F. (32° C.) or less. However, in certain embodiments of the invention, the aqueous bath 18 may be warmed to higher temperatures, if desired, to accelerate the stripping process. This may be achieved by adding a heat source (not shown) adapted to heat the electrolyte in aqueous bath 18. In other embodiments of the invention and as described hereinafter, the aqueous bath 18 may also be chilled to limit the temperature.

With reference to FIG. 3, the stripping apparatus 25 further includes a counter electrode 22 associated with aqueous bath 18, such as by being contacted or immersed in container 20 with metal component 12. The counter electrode 22 may be formed from graphite or from other materials such as gold, platinum, or Hastelloy C-276. Metal component 12 has a first natural standard electrode potential E°, and counter electrode 22 has a second natural standard electrode potential E° greater than the E° of the metal component 12. Counter electrode 22 and metal component 12 are DC coupled by an electrical path or coupling, as exemplified by a wire 24, to establish a circuit. The surface area of the counter electrode 22 may be approximately equal to the surface area of the metal component 12. Alternatively, the counter electrode 22 may be introduced as a liner inside the container 20, and the metal component 12 may be placed or otherwise rest directly on the liner to establish the DC coupling with the counter electrode 22.

The standard electrode potential, E°, which is expressed in volts, is defined as the potential of an element immersed in a solution of its ions at unit activity. E° may be measured by electrochemical impedance spectroscopy (EIS). A driving or electromotive force (EMF) results from the relative potential forces of the two dissimilar electrodes (i.e., the metal component 12 and the counter electrode 22). The greater the magnitude of the differential between the E° values of the metal component 12 and the counter electrode 22, the greater the EMF produced, and thus a faster and more effective stripping of the coating 10 may be obtained.

Although not wishing to be bound by theory, the use of the counter electrode 22 is believed to eliminate or significantly reduce the risks associated with hydrogen embrittlement of the metal component 12 by reducing hydrogen infiltration from the aqueous bath 18 into the metal component 12. The metal component 12 operates as an anode during stripping, while the counter electrode 22 operates as the cathode on which substantially all cathodic activity occurs. The surface 16 of metal component 12 surrenders electrons by virtue of the E° differential between the metal component 12 and the counter electrode 22.

Figure 4:
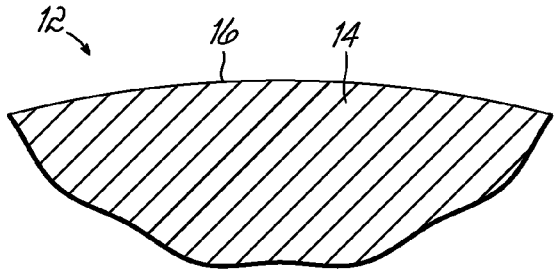
FIG. 4 is a cross-sectional view similar to FIG. 2 after the coating is stripped from the metal component.

The stripping process is continued until the coating 10 is at least partially removed and, preferably, completely removed from metal component 12 to expose original surface 16, as is apparent in FIG. 4. The solution in bath 18 may be stirred or otherwise agitated to enhance the removal rate of coating 10. For example, an ultrasonic probe 26 may be inserted into the aqueous bath 18 to produce shock waves that agitate the solution constituting the aqueous bath 18. Other examples of agitating mechanisms are a mechanical agitator with, for example, a bladed impeller or a pump (not shown) that adds and extracts solution from the tank to thereby agitate the aqueous bath 18. The pumped solution may be filtered to remove particulates that accumulate in the aqueous bath 18. The pumping may be continuous or intermittent and the filtered solution may be returned to the container 20 through a sparger that injects the returned solution with jets oriented to direct flows generally toward the metal component 12. As described hereinafter, the pumped solution may also be chilled to control the temperature of the aqueous bath 18.

With continued reference to FIG. 3, an optional external power source 28 may be placed in the circuit coupling the metal component 12 and counter electrode 22 to add an additional EMF that may, for example, be in the range of one (1) to six (6) volts. The additional EMF modifies the E° differential between the metal component 12 and the counter electrode 22. A positive cathode of the optional power source 28 is DC coupled to the metal component 12, and a negative anode of the optional power source 28 is DC coupled to the counter electrode 22. The power source 28 supplies an external voltage in the negative sense from the counter electrode 22 to the metal component 12 that expands the effect of the natural E° differential. The presence of the negative potential is believed to advantageously increase the removal rate of the coating 10 while the metal component 12 is contacted by or immersed in the aqueous bath 18 and DC coupled with the counter electrode 22. In particular, the use of power source 28 may be particularly beneficial for increasing the removal rate of WCCoCr, wherein the chromium is only 4% of the chemistry of the coating 10.

In one aspect of the invention, the electrolyte in aqueous bath 18 may be a dilute aqueous solution consisting of a mixture of water ($H_2O$), a source of active oxygen such as hydrogen peroxide ($H_2O_2$), and a substance that behaves as a ligand for removed metal. The ligand may be an acid selected from citric acid ($C_6H_8O_7$), oxalic acid ($C_2H_2O_4$), tartaric acid ($C_4H_6O_6$), glucose (6-(hydroxymethyl)oxane-2,3,4,5-tetrol), or formic acid ($CH_2O_2$). A person having ordinary skill in the art understands that a ligand is an atom, ion, or molecule that donates one or more of its electrons through a coordinate covalent bond to, or shares its electrons through a covalent bond with one or more central metal atoms or ions to form a complex.

The measured oxidization reduction potential or oxygen concentration of the aqueous bath 18 provides a qualitative measure of the oxidation power of the aqueous bath 18. The oxidation power provides an indication of the solution's ability to oxidize another the constituent material of the coating 10. The measured oxidization reduction potential or oxygen concentration is related to the concentration of active oxygen in the aqueous bath 18 and the activity or strength of the source of active oxygen. As the coating 10 is removed, active oxygen is consumed in the process, which causes the measured oxidation reduction potential or oxygen content of the aqueous bath 18 to change in a predictable manner that can be correlated with the concentration of active oxygen in the aqueous bath 18. The pH of the aqueous bath 18, as well as the concentration of ligand that is not bound with metal ions from the coating 10 and dissolved in bath 18, also changes during the coating removal process.

In one specific embodiment of the invention, the aqueous bath 18 includes a volume of hydrogen peroxide sufficient to provide a level of about 3 percent of the total solution volume, about 2 grams (about 0.07055 ounce) of citric acid per liter of solution, and the rest water. In another specific embodiment of the invention, the aqueous bath 18 includes a total volume of 60 gallons (227.1 liters), about 0.00833 volume percent of hydrogen peroxide (i.e., about 0.5 gallons (about 1.893 liters)), about 120 grams (about 4.233 ounces) of citric acid per liter of solution, and the rest water. In another embodiment, the composition of the aqueous bath 18 contains hydrogen peroxide at a level of about 1 wt. % to about 32 wt. %, with the balance being water and ligand.

Although not wanting to be bound by theory, the use of citric acid or another of the described acids or functionally-equivalent acids is believed to enhance the removal of metal from the coating 10 by operating as a chelating agent that binds the metal ions removed from metal component 12 by the hydrogen peroxide and, on that basis, to enhance the removal rate for stripping coating 10 from metal component 12.

The stripping apparatus 25 may include a probe or sensor 30 capable of measuring the oxidation reduction potential of the aqueous bath 18 during the stripping process. Sensor 30 may be any suitable oxidation reduction potential sensor such as, for example, an electrochemical-type sensor. In particular, sensor 30 may comprise an electrode with a measuring half cell comprised of platinum metal immersed in the aqueous bath 18 and sealed a reference half cell to which the platinum half cell is referenced. Although sensor 30 is depicted as positioned inside the container 20 and wetted by bath 18, sensor 30 may alternatively be a non-contact sensor otherwise positioned. Sensor 30 generates output signals that correspond to, or are proportional to, successive measurements of the oxidation reduction potential of aqueous bath 18.

Alternatively, sensor 30 may be an oxygen sensor that is configured to directly detect the concentration of oxygen dissolved in the solution constituting the aqueous bath 18. In one embodiment, the sensor 30 may be an electrode-type oxygen sensor that operates by an electrochemical mechanism. The electrode-type oxygen sensor 30 includes a cathode and an anode that are submersed in the aqueous bath 18. Oxygen enters the electrode-type oxygen sensor 30 through a permeable membrane by diffusion from the aqueous bath 18, and is reduced at the cathode, creating a measurable electrical current that is communicated from the sensor 30 to the control system 34, as described below. The electrical current is proportional to the oxygen concentration in the bath 18. In an alternative embodiment, the sensor 30 may be an optical-type oxygen sensor that optically measures the oxygen concentration. Typically, the optical-type oxygen sensor 30 will include an optical cable and a fluorescent film attached to the tip of the optical cable. The fluorescence from the fluorescent film, which is contingent on the oxygen concentration in the aqueous bath 18, is analyzed by the control system 34 as indicative of the oxygen content.

The stripping apparatus 25 may also include a probe or sensor 31 capable of measuring the pH of the aqueous bath 18 during the stripping process. The pH sensor 31 may be any suitable pH sensor, such as a device having a working electrode and a reference electrode. Although pH sensor 31 is depicted as positioned inside the container 20 and wetted by bath 18, pH sensor 31 may alternatively be a non-contact sensor otherwise positioned. Sensor 31 generates output signals that correspond to, or are proportional to, successive measurements of the pH of aqueous bath 18. As understood by a person of ordinary skill in the art, the pH is a measure of the activity of hydrogen ions ($H^+$) in the aqueous bath 18 and, therefore, the acidity or alkalinity. The pH value, which is a dimensionless number between 0.0 and 14.0, indicates whether a solution is acidic (pH<7), neutral (pH=7), or basic/alkaline (pH>7).

With continued reference to FIG. 3, the sensor 30 and pH sensor 31 are coupled electrically with a control system 34 of the stripping apparatus 25 by communication links 32, 33, respectively. The communication links 32, 33 may be constituted by a cable or wire, a radiofrequency (RF) link, or an infrared (IR) link. The output signals generated by the sensor 30 are directed over the communication link 32 to the control system 34. Similarly, the output signals generated by the pH sensor 31 are directed over the communication link 33 to the control system 34. The output signals from sensors 30, 31 may be provided to the control system 34 at various different time intervals between successive measurements as required to maintain control over the composition of the solution forming the aqueous bath 18. The output signals may be periodically, aperiodically, or continuously generated in response to the successive measurements, but are repeatedly measured without user intervention and supplied as feedback to the control system 34 for responding to the generated output signals.

Control system 34 is electrically coupled with an active oxygen source supply 38 of the stripping apparatus 25 over a communications link 40, such a wire, a radiofrequency (RF) link, or an infrared (IR) link. The active oxygen source supply 38 includes a valve or flow control device 42 that the control system 34 can command to open and close for adding additional amounts 43 of the active oxygen source to the aqueous bath 18. The active oxygen source supply 38 is a conventional structure that includes a bulk supply of the active oxygen source and any additional components as understood by a person of ordinary skill in the art required for holding and transferring such substances.

Control system 34 is also electrically coupled with a ligand supply 48 of the stripping apparatus 25 over a communications link 50, such a wire, a radiofrequency (RF) link, or an infrared (IR) link. The ligand supply 48 includes a valve or flow control device 52 that the control system 34 can command to open and close for adding additional amounts 53 of the ligand to the aqueous bath 18. The ligand supply 48 is a conventional structure that includes a bulk supply of the ligand and any additional components as understood by a person of ordinary skill in the art required for holding and transferring such substances.

Control system 34 relies on a software algorithm and/or user input to respond to electrical signals supplied from sensor 30. Specifically, control system 34 may respond to a change (e.g., deficiency) in the amount of the source of active oxygen, as indicated by successive output signals representative of the measured oxidation reduction potential or oxygen concentration supplied from sensor 30, by causing additional amounts 43 of the active oxygen source to be transferred from the active oxygen source supply 38 through a transfer pathway 36 to the aqueous bath 18. A person of ordinary skill in the art will appreciate that other types of fluid transfer pathways 36 may be established, such as piping (not shown) extending from the active oxygen source supply 38 through the wall of the container 20. In the illustrated embodiment, the transfer pathway 36 is illustrated as introducing added amounts 43 of the active oxygen source at a location proximate to the sensor 30. However, the invention is not so limited as the transfer pathway 36 may introduce these additional amounts 43 of the active oxygen source at other locations so long as the added amounts are contained inside of container 20.

The control system 34 of the stripping apparatus 25 may compare the measured oxidation reduction potential or oxygen concentration as indicated by the sensor 30 with a reference oxidation reduction potential or oxygen concentration. Based upon the comparison, the control system 34 may instruct the active oxygen source supply 38 to add an amount 43 of the source of active oxygen to the aqueous bath 18 effective to increase the oxidation reduction potential. The oxidation reduction potential or oxygen concentration of the aqueous bath 18 may be increased to a measured value comparable or equal to the reference value. The control system 34 may regulate the rate of addition of the active oxygen source to maintain the measured oxidation reduction potential or oxygen concentration within an effective range for at least partially removing the coating 10 from the contacted portion of the metal component 12.

Control system 34 likewise relies on a software algorithm and/or user input to respond to electrical signals supplied from sensor 31. Specifically, control system 34 may respond to a change in the pH of aqueous bath 18, as indicated by successive output signals representative of the measured pH supplied from sensor 31, by causing additional amounts 53 of the ligand to be transferred from the ligand supply 48 through a transfer pathway 54 to the aqueous bath 18. A person of ordinary skill in the art will appreciate that other types of fluid transfer pathways 54 may be established, such as piping (not shown) extending from the ligand supply 48 through the wall of the container 20. In the illustrated embodiment, the transfer pathway 54 is illustrated as introducing added amounts 53 of the ligand at a location remote from the sensor 31. However, the invention is not so limited as the transfer pathway 54 may introduce these additional amounts 53 of the ligand at other locations so long as the added amounts are contained inside of container 20.

The control system 34 of the stripping apparatus 25 may compare the measured pH as indicated by the sensor 31 with a reference pH. If the measured pH differs from the reference pH, the control system 34 may instruct the ligand supply 48 to add an amount of the ligand to the aqueous bath 18 effective to decrease (or increase) the pH. The pH of the aqueous bath 18 may be increased to a measured pH value comparable or equal to the reference pH value. The control system 34 may regulate the rate of addition of the ligand to maintain the measured pH value within an effective range for at least partially removing the coating 10 from the contacted portion of the metal component 12 without attacking or damaging the substrate 14.

The invention contemplates that the active oxygen source and/or ligand may be added to the aqueous bath 18 as a solid, rather than in a liquid form as depicted in FIG. 3.

The stripping apparatus 25 may optionally include a recirculation system with a pump 56 and a chiller 58 that cooperate to regulate the temperature of the aqueous bath 18 in container 20. A temperature sensor 57, which is connected with the control system 34 by a communication link similar to communication links 32, 33, may measure the temperature of the solution in the aqueous bath 18 and provide output signals representing the temperature as feedback to the control system 34. The control system 34 can use the temperature feedback for closed-loop control of the operation of chiller 58 so as to maintain the temperature of the aqueous bath 18 at or below a maximum temperature, or with a temperature range.

The ability of regulate the temperature of the aqueous bath 18 may be beneficial for use with a bath chemistry that contains hydrogen peroxide ($H_2O_2$) as the active source of oxygen and citric acid as the ligand. In one embodiment of the invention, the temperature of the aqueous bath 18 is regulated such that the bath temperature is kept at about 95° F. (32° C.) or less, which limits the loss of active oxygen from the hydrogen peroxide in the bath 18 to the ambient atmosphere surrounding the stripping apparatus 25. This permits the pH value of the aqueous bath 18 to be maintained at about 2.0, or lower, during the operation of the stripping apparatus 25 and by additions of citric acid sufficient to establish this pH value, which may increase the efficiency of removing coatings 10 of certain compositions. In another embodiment, the pH of the aqueous bath 18 is maintained in a range of about 1.75 to about 2.75 and the temperature is controlled to avoid excess peroxide disassociation. If not temperature controlled while stripping, the concentration of hydrogen peroxide in the aqueous bath 18 in combination with the low pH value may also cause the temperature to rise above about 95° F. and, as a result, prompt an uncontrolled loss of active oxygen from the bath 18. In another embodiment, the temperature of the aqueous bath 18 may be maintained by temperature control in a range between about 30° C. (85° F.) and about 33° C. (91° F.).

With reference to FIG. 3, the stripping apparatus 25 may optionally include a base supply 62 that is adapted to transfer amounts 60 of a base substance through a transfer pathway 64 to the aqueous bath 18. A person of ordinary skill in the art will appreciate that other types of fluid transfer pathways 64 may be established, such as piping (not shown) extending from the base supply 62 through the wall of the container 20. Control system 34 is electrically coupled with the base supply 62 of the stripping apparatus 25 over a communications link 66, such a cable or wire, a radiofrequency (RF) link, or an infrared (IR) link. The base supply 62 includes a valve or flow control device 68 that the control system 34 can command to open and close for adding additional amounts 60 of the base to the aqueous bath 18. Base supply 62 is a conventional structure that includes a bulk supply of the base and any additional components as understood by a person of ordinary skill in the art required for holding and transferring such substances. The base supply 62 may be omitted if the composition of the aqueous bath 18 lacks a base/alkaline substance.

The control system 34 of the stripping apparatus 25 may compare the measured pH as indicated by the sensor 31 with a reference pH. If the measured pH differs from the reference pH, the control system 34 may instruct the base supply 62 to add an amount of the base to the aqueous bath 18 effective to decrease the pH. The pH of the aqueous bath 18 may be decreased to a measured pH value comparable or equal to the reference pH value by instructing the base supply 62 to add amounts 60 of the base to the aqueous bath 18. The control system 34 may regulate the rate of addition of the base to maintain the measured pH value within an effective range for at least partially removing the coating 10 from the contacted portion of the metal component 12 without attacking or damaging the substrate 14.

The original surface 16, when exposed after the coating 10 is stripped, may be susceptible to damage from, for example, corrosion. To that end and in certain embodiments of the invention, amounts of the base substance may be added to the aqueous bath 18 sufficient to adjust the pH to a pH value that prevents damage to the metal component 12 after the coating 10 is removed. Damage is prevented without significantly altering the stripping rate or, at the least, only altering the stripping rate within tolerable limits. The added amount 60 of the base is be sufficient to adjust the pH to a pH value greater than about 7.0 but less than, or equal to, 8.0. This maintains the solution pH at a neutral to slightly basic/alkaline value. In another embodiment, the pH of the aqueous bath 18 is maintained at a pH value in the range of about 7.0 to about 9.0.

An exemplary chemical substance useful for adjusting the pH is sodium hydroxide (NaOH), which is available commercially in various solid forms, e.g., pellets, sticks, or chips, and in water solutions of various concentrations, and is commonly known as caustic soda, lye, or sodium hydrate. The ability to adjust the pH may be particularly advantageous for preventing corrosion, which may have the form of rust, of metal components 12 in which the substrate 14 is formed from a material susceptible to corrosion. Exemplary corrosion-susceptible materials for substrate 14 include, but are not limited to, 4140 and 4340 stainless steels.

For operation at these pH values, the source of active oxygen in the aqueous bath 18 may be a chemical compound or substance such as sodium perborate tetrahydrate ($NaBO_3.4H_2O$), sodium perborate monohydrate ($NaBO_3.H_2O$) prepared by dehydrating sodium perborate tetrahydrate, sodium percarbonate ($Na_2CO_3.1½H_2O_2$), boric acid ($H_3BO_3$), mixtures of these chemical compounds or substances, or the like. In one embodiment, the source of active oxygen may be present at a level of from 1% to 30% by weight of the composition. The chemical substance supplying the active oxygen may undergo dissociation or hydrolysis in contact with water, producing active oxygen in the aqueous bath 18. The pH of the aqueous bath 18 may be adjusted using the alternative active oxygen source to a pH value greater than about 7.0 and less than, or equal to, 8.0 without concerns regarding the evaporative loss of hydrogen peroxide. Replacing hydrogen peroxide with a different active oxygen source eliminates the difficulties associated with the expected loss of hydrogen peroxide from the aqueous bath 18 at elevated pH values.

In one embodiment, use of $NaBO_3.4H_2O$, $NaBO_3.H_2O$, $Na_2CO_3.1½H_2O_2$, or $H_3BO_3$ may permit coating 10 to be simultaneously removed from multiple metal components 12 placed in the aqueous bath 18 in a situation in which different components 12 have coatings 10 of different compositions. For example, the composition of the coating 10 on one metal component 12 may be WCCo and the composition of the coating 10 on another metal component 12 may be CrC/NiCr. Yet, the stripping conditions in the stripping apparatus 25 promote the efficient stripping of the two different types of coating 10. This ability permits coatings 10 of different compositions to be simultaneously stripped from batches of metal components 12 without actually determining the specific coating compositions. In addition, coating 10 may include material of one composition, such as WCCo, on one region of the metal component 12 and material with another composition, such as CrC/NiCr, on another region of the metal component 12, yet the stripping conditions in the stripping apparatus 25 promote efficient stripping. In one embodiment of the invention, the temperature of the aqueous bath 18 is regulated such that the temperature of the aqueous bath 18 is maintained in a range at about 50° C. (122° F.) to about 65° C. (149° F.), which may promote faster coating removal than for temperatures less than about 50° C.

In one embodiment, the chemistry of the solution in the aqueous bath 18 may include sodium citrate, sodium carbonate and sodium perborate with each component present at about one-third molar concentration for each component. In another embodiment, the chemistry of the solution in the aqueous bath 18 may include about ⅔ molar sodium citrate, 0.2 molar or 0.1 molar sodium perborate, and about ⅓ sodium carbonate. The pH may be adjusted by additions of sodium citrate to maintain the pH in a range of about 7.0 to about 9.0.

In accordance with this embodiment, the control system 34 may respond to a change in the pH of aqueous bath 18 occurring during the coating removal process, as indicated by successive output signals representative of the measured pH supplied from sensor 31, by causing amounts 60 of the base substance to be transferred to the aqueous bath 18. This increases the pH to maintain the pH within the desired range.

In certain alternative embodiments of the invention, regions on the metal component 12 may be masked with a protective coating to prevent contact with, or wetting by, the aqueous bath 18. In particular, regions on metal component 12 that are not coated by coating 10 may be covered by the protective coating, which operates as a barrier preventing contact or wetting by the aqueous bath 18. After the stripping process removes coating 10, the protective coating is likewise stripped. Certain types of metal components 12 may include an outer paint layer that is removed before the protective coating is applied or the metal component 12 is contacted with the aqueous bath 18 to strip the coating 10. An exemplary protective coating is a silane, such as BTSE.

U.S. Pat. Nos. 6,294,072, 6,645,365, and 6,837,985, which describe similar apparatus and methods for stripping, are hereby incorporated by reference herein in their entirety.

While the invention has been illustrated by the description of an embodiment thereof and specific examples, and while the embodiment has been described in considerable detail, it is not intended to restrict or in any way limit the scope of the appended claims to such detail. Additional advantages and modifications will readily appear to those skilled in the art. For example, a person of ordinary skill in the art will appreciate that general coatings may be stripped from other types of metal components using a stripping apparatus including the concentration sensor, as described herein, and that this aspect of the invention is not limited to stripping coatings from metal components of landing gears and exhaust augmentor flaps. The invention in its broader aspects is therefore not limited to the specific details, representative apparatus and methods and illustrative examples shown and described. Accordingly, departures may be made from such details without departing from the scope or spirit of applicant's general inventive concept.

What is claimed is:

1. A method for at least partially removing a coating from a metal component, the method comprising: contacting at least a portion of the metal component with an aqueous electrolytic bath comprising water, active oxygen, and a ligand; at least partially removing the coating from the contacted portion of the metal component while the metal component portion is in contact with the aqueous electrolytic bath; measuring an active oxygen concentration of the aqueous electrolytic bath; comparing the measured active oxygen concentration with a reference oxygen concentration; and adding an amount of an active oxygen source to add active oxygen to the aqueous electrolytic bath if the measured active oxygen concentration is less than the reference oxygen concentration.

2. The method of claim 1 further comprising:

regulating the rate of addition of the active oxygen source to maintain the measured active oxygen concentration within an effective range for at least partially removing the coating from the contacted portion of the metal component.

3. The method of claim 1 further comprising:

DC coupling the metal component with a counter electrode having a greater E° than the metal component while at least partially removing the coating from the contacted portion of the metal component.

4. The method of claim 3 wherein DC coupling the metal component with the counter electrode further comprises:

placing an external power source in a circuit coupling the metal component and the counter electrode.

5. The method of claim 1 further comprising:

partially masking the metal component before the metal component is placed in contact with the aqueous bath.

6. The method of claim 1 further comprising:

measuring a pH value of the aqueous electrolytic bath; and adjusting a pH of the aqueous electrolytic bath to maintain the measured pH value in a range of about 1.75 to about 2.75.

7. The method of claim 6 wherein adjusting the pH of the aqueous electrolytic bath further comprises:

adding an amount of the ligand to the aqueous electrolytic bath effective to decrease the measured pH to the range of about 1.75 to about 2.75.

8. The method of claim 1 further comprising:

adjusting a temperature of the aqueous electrolytic bath, while the metal component is contacted by the aqueous electrolytic bath.

9. The method of claim 8 wherein adjusting the temperature further comprises:

chilling the aqueous electrolytic bath, while the metal component portion is contacted by the aqueous electrolytic bath, to maintain the temperature of the aqueous electrolytic bath in a range between about 50° C. and about 65° C.

10. The method of claim 8 wherein adjusting the temperature further comprises:

maintaining the temperature of the aqueous electrolytic bath, while the metal component portion is contacted by the aqueous electrolytic bath, in a range between about 30° C. and about 33° C.

11. An apparatus for removing a coating from a metal component using an aqueous bath with a composition having multiple components, the apparatus comprising:

a container configured to hold the aqueous electrolytic bath;

a first sensor in fluid communication with the aqueous electrolytic bath, the first sensor adapted to measure an oxygen concentration of the aqueous electrolytic bath and generate output signals corresponding to the measured oxygen concentration; and a control system electrically coupled with the first sensor, the control system responsive to the output signals from the first sensor to cause an additional amount of a first component to be added to the aqueous electrolytic bath as the coating is removed from the metal component.

12. The apparatus of claim 11 further comprising:

a counter electrode disposed in the container, the counter electrode adapted to be DC coupled with the metal component, and the counter electrode having a greater E° than the metal component.

13. The apparatus of claim 12 further comprising:

an external power source in a circuit DC coupling the metal component and the counter electrode.

14. The apparatus of claim 12 further comprising:

a second sensor adapted to measure the pH of the aqueous electrolytic bath and generate output signals corresponding to the measured pH, the control system electrically coupled with the second sensor, and the control system responsive to the output signals from the second sensor to cause an additional amount of a second component to be added to the aqueous bath.

* * * * *